US011239560B2

(12) United States Patent
Alfaro

(10) Patent No.: US 11,239,560 B2
(45) Date of Patent: Feb. 1, 2022

(54) ULTRA WIDE BAND ANTENNA

(71) Applicant: DESARROLLO DE TECNOLOGIA E INFORMÄTICA APLICADA, S.A.P.I. DE C.V., Monterrey (MX)

(72) Inventor: Roy Michel Alfaro, Monterrey (MX)

( * ) Notice: Subject to any disclaimer, the term of this patent is extended or adjusted under 35 U.S.C. 154(b) by 334 days.

(21) Appl. No.: 16/221,161

(22) Filed: Dec. 14, 2018

(65) Prior Publication Data

US 2019/0190153 A1 Jun. 20, 2019

Related U.S. Application Data

(60) Provisional application No. 62/598,900, filed on Dec. 14, 2017.

(51) Int. Cl.

| | |
|---|---|
| ***H01Q 5/50*** | (2015.01) |
| ***H01Q 9/42*** | (2006.01) |
| ***H01Q 5/25*** | (2015.01) |
| ***H01Q 9/40*** | (2006.01) |
| ***H01Q 1/38*** | (2006.01) |
| ***H01Q 9/04*** | (2006.01) |

(52) U.S. Cl.

CPC ..... *H01Q 5/50* (2015.01); *H01Q 5/25* (2015.01); *H01Q 9/045* (2013.01); *H01Q 9/40* (2013.01); *H01Q 9/42* (2013.01); *H01Q 1/38* (2013.01)

(58) Field of Classification Search

CPC ..... H01Q 5/50; H01Q 5/25; H01Q 9/045; H01Q 9/40; H01Q 9/42; H01Q 1/38

See application file for complete search history.

(56) References Cited

U.S. PATENT DOCUMENTS

| | | | | |
|---|---|---|---|---|
| 6,157,344 | A * | 12/2000 | Bateman | G06F 1/1616 343/700 MS |
| 6,300,914 | B1 | 10/2001 | Yang | |
| 6,525,691 | B2 | 2/2003 | Varadan et al. | |
| 6,917,334 | B2 | 7/2005 | Chen | |
| 6,917,336 | B2 | 7/2005 | Rowser et al. | |
| 6,975,277 | B2 | 12/2005 | Tran | |
| 7,239,283 | B2 | 7/2007 | Chua | |
| 7,248,223 | B2 | 7/2007 | Habib et al. | |
| 7,265,717 | B2 | 9/2007 | Saitou et al. | |
| 7,365,701 | B2 | 4/2008 | Werner et al. | |
| 7,403,164 | B2 | 7/2008 | Sanz et al. | |
| 7,417,588 | B2 | 8/2008 | Castany et al. | |
| 7,436,360 | B2 | 10/2008 | Chen et al. | |
| 7,791,539 | B2 | 9/2010 | Soler Castany et al. | |
| 8,237,615 | B2 | 8/2012 | Anguera et al. | |
| 8,405,552 | B2 | 3/2013 | Bae et al. | |
| 8,738,103 | B2 | 5/2014 | Puente Baliarda et al. | |
| 9,343,810 | B2 | 5/2016 | Chen et al. | |
| 2004/0017317 | A1 | 1/2004 | Schmiade | |
| 2008/0024369 | A1* | 1/2008 | Shinkai | H01Q 9/42 343/700 MS |
| 2008/0094297 | A1 | 4/2008 | Petkov et al. | |
| 2009/0195459 | A1 | 8/2009 | Chua | |
| 2019/0081388 | A1* | 3/2019 | Lo Hine Tong | H01Q 7/00 |

* cited by examiner

*Primary Examiner* — Dimary S Lopez Cruz
*Assistant Examiner* — Noel Maldonado
(74) *Attorney, Agent, or Firm* — Staas & Halsey LLP

(57) ABSTRACT

A monopole-radiating element of antenna has a single order fractal signal feed. No series or shunt impedance matching elements are connected to the radiating element to control the antenna operating parameters.

7 Claims, 2 Drawing Sheets

ULTRA WIDE BAND ANTENNA

CROSS-REFERENCE TO RELATED APPLICATION(S)

This application is related to and claims priority to U.S. provisional application Ser. No. 62/598,900, entitled Ultra Wide Band Antenna, by Roy Alfaro, filed Dec. 14, 2017 and incorporated by reference herein.

BACKGROUND

1. Field

The embodiments discussed herein are directed to antennas for transmitting and receiving radio frequency signals, and more specifically to a monopole antenna.

2. Description of the Related Art

Due to the evolution of wireless communications in the area of cellular telephony, wireless local area networks (WLANs) and wireless personal area networks (WPANs), particularly in the frequency range between 800 MHz and 5 GHz, new types of antennas are urgently needed. Today, an Ultra Wide Band (UWB) system is used as a wireless RF interface between mobile terminals (cell phones, laptops, PDAs, wireless cameras or MP3 players) with much higher data rates than Bluetooth or IEEE 802.11.

It is generally known that antenna performance is dependent upon the size, shape and material composition of the constituent antenna elements, as well as the relationship between certain antenna physical parameters (e.g., length for a linear antenna and diameter for a loop antenna) and the wavelength of the signal received or transmitted by the antenna. These relationships determine several antenna operational parameters, including input impedance, gain, directivity and radiation pattern. Generally for an operable antenna, the minimum physical antenna dimension (or the electrically effective minimum dimension) must be on the order of a quarter wavelength (or a multiple thereof) of the operating frequency, which thereby advantageously limits the energy dissipated in resistive losses and maximizes the energy transmitted. Quarter wavelength and half wavelength antennas are commonly used.

As known in the art, there is a direct relationship between physical antenna size and antenna gain, at least with respect to a single-element antenna. As a further constraint, to simplify the system design and strive for minimum cost, equipment designers and system operators prefer to utilize antennas capable of efficient multi-frequency and/or wide bandwidth operation, allowing the communications device to access various wireless services operating within different frequency bands from a single antenna. Finally, gain is limited by the known relationship between the antenna frequency and the effective antenna length (expressed in wavelengths).

One basic antenna commonly used in many applications today is the half-wavelength dipole antenna. The radiation pattern is the familiar omnidirectional donut shape with most of the energy radiated uniformly in the azimuth direction and little radiation in the elevation direction. A quarter-wavelength monopole antenna placed above a ground plane is derived from a half-wavelength dipole. The physical antenna length is a quarter-wavelength, but with the ground plane the antenna performance resembles that of a half-wavelength dipole. Thus, the radiation pattern for a monopole antenna above a ground plane is similar to the half-wavelength dipole pattern, with a typical gain of approximately 2 dBi.

Using a quarter wavelength of the radiating frequency, an antenna may be constructed over a ground plane, e.g., separated by the thickness of a printed circuit board. These dimensions allow the antenna to be easily excited and operated at or near a resonant frequency, limiting the energy dissipated in resistive losses and maximizing the transmitted energy.

As the operational frequency increases and decreases, the operational wavelength correspondingly decreases and increases. Known quarter wavelength antennas are designed to present a dimension that is a quarter or half wavelength at the operational frequency, so that when the operational frequency changes, the antenna is no longer operating at a resonant condition and antenna performance deteriorates.

Every antenna exhibits known advantages and disadvantages. The dipole antenna has a reasonably wide bandwidth and a relatively high gain. The major drawback of the dipole, in personal wireless communications devices, is its size. By comparison, the patch antenna or the loop antenna over a ground plane present a lower profile resonant device than the dipole, but operate over a narrower bandwidth with a highly directional radiation pattern.

The patch in the top layer of microstrip antennas typically have shapes such as circles or rectangles to simplify analysis and performance prediction. Known microstrip antennas have several drawbacks compared to conventional microwave antennas, e.g. narrow bandwidth (typically in the order of 2%), a comparatively high dissipation power and therefore a lower gain (about 20 dB), a relatively poor end-fire radiation performance, and the possibility to excite surface waves. Furthermore, the majority of conventional microwave antennas radiate most of the energy into only a half plane. It is possible, however, to find remedies against some of these disadvantages by using appropriate designs.

Antennas are usually specified according to a set of parameters comprising operating frequency, gain, Voltage Standing Wave Ratio (VSWR), input impedance and bandwidth. If the VSWR is greater than 3, for instance, a matching network must be placed between the transmitter and its antenna to minimize mismatch loss, although a low VSWR is not a design necessity as long as the antenna is an efficient radiator.

SUMMARY

It is an aspect of the embodiment discussed herein to provide an asymmetrical monopole antenna with a single order fractal signal feed, operating over a wide bandwidth of frequencies (800 Mhz to 5 GHz), having an omnidirectional radiation pattern and printed on a semiconductor substrate where the RF front-end chip is placed.

Another aspect of the embodiment discussed herein is to provide an ultra-wideband antenna that fulfills the need of the Machine to Machine (M2M) market, where antenna size is of secondary importance to antenna efficiency, construction simplicity and cost.

An embodiment provides a single-feed, Ultra Wide Band GSM/DCS/W-Fi/Bluetooth/Zigbee antenna wherein the radiating element is formed on a PCB that is directly connected to the microwave radio transceiver.

An embodiment provides a wide bandwidth that is not dependent on self-symmetry or fractional quarter-wave length repetitions and having a size not linked to operating frequency.

An embodiment provides a system impedance within 2% of optimal 50 ohms in the operating frequency range.

The above aspects can be attained by an antenna formed on a dielectric substrate having first and second sides opposing each other, including a first conductive pattern formed on the first side of the dielectric substrate forming an asymmetrical monopole with a single order fractal signal feed; and a second conductive pattern formed on the second side of the dielectric substrate, forming a ground plane under the single order fractal signal feed.

According to an aspect, the asymmetrical monopole is a five-sided polygon encompassing two rectangles and an isosceles right triangle. The first rectangle has shorter sides with lengths within 65% of the lengths of the longer sides. The first longer side of the first rectangle is adjacent a first leg of the isosceles right triangle. The isosceles right triangle has a hypotenuse extending from a corner formed by the first shorter side and the first longer side of the first rectangle to a corner of the second rectangle. A second leg of the isosceles right triangle is adjacent a first longer side of the second rectangle, with one of two shorter sides of the second rectangle adjacent the first longer side of the first rectangle and co-linear and contiguous with the first leg of the isosceles right triangle. A second longer side of the second rectangle is co-linear and contiguous with the second shorter side of the first rectangle.

According to an aspect, the single order fractal signal feed has first and second co-linear segments joined by first and second angled segments, with the first and second angled segments joined at first ends forming a third corner having a substantially 90° angle, and the first co-linear segment having a side co-linear and contiguous with the second longer side of the second rectangle.

According to an aspect, the first angled segment of the single order fractal signal feed has a second end joining the first co-linear segment of the single order fractal signal feed and a side co-linear with the hypotenuse of the isosceles right triangle.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

These and other aspects and advantages will become more apparent and more readily appreciated from the following description of the exemplary embodiments, taken in conjunction with the appended drawings of which.

DETAILED DESCRIPTION OF THE EMBODIMENTS

Multi-band or wide bandwidth antenna operation is especially desirable for use with various communications devices. The antenna illustrated in FIG. 1A has multi-band capability in a single monopole antenna and relies upon higher-order resonant frequencies of the monopole structure to obtain a radiation capability in a higher frequency band. An alternative for multi-band performance is to use two separate antennas, placed in proximity, with coupled inputs or feeds according to known methods in the art.

In the prior art it has been difficult to realize an efficient antenna or antenna system that provides multi-band, wide bandwidth operational features in a relatively small physical volume. In an effort to overcome some of the disadvantages associated with the use of monopole, dipole, loop and patch antennas, a slow wave structure has been developed with antenna physical dimensions that are not equal to its effective electrical dimensions.

Generally, a slow-wave structure is defined as one in which the phase velocity of the traveling wave is less than the free space velocity of light. The wave velocity is the product of the wavelength and the frequency and takes into account the material permittivity and permeability. Since the frequency remains unchanged during propagation through a slow wave structure, if the wave travels slower than the speed of light in a vacuum, the wavelength within the structure is lower than the free space wavelength. The slow-wave structure de-couples the conventional relationship between physical length, resonant frequency and wavelength.

Since the phase velocity of a wave propagating in a slow-wave structure is less than the free space velocity of light, the effective electrical length of these structures is greater than the effective electrical length of a structure propagating a wave at the speed of light. The resulting resonant frequency for the slow-wave structure is correspondingly increased.

Figure 1A:
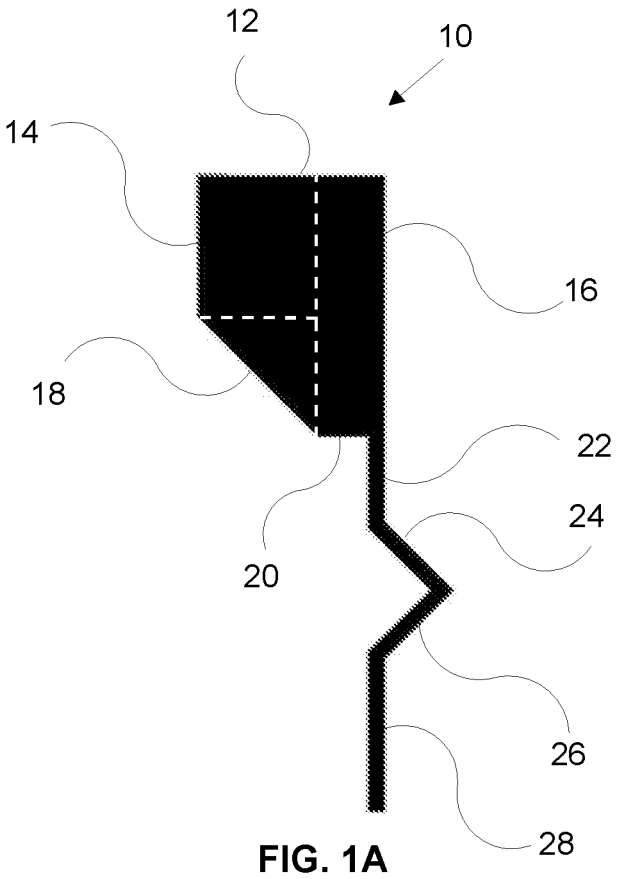
FIG. 1A is a radiating strip conductor patch of an embodiment to the antenna that may be formed on top of a thin dielectric substrate or air sheet.
Figure 1B:
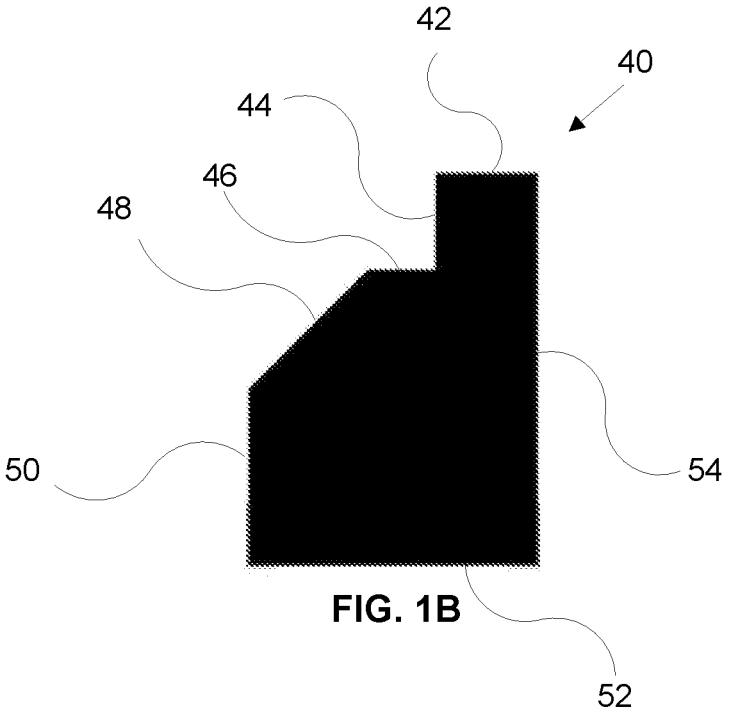
FIG. 1B is a metallic ground plane that may be formed on the opposite side of the substrate or air sheet.

The microstrip or patch antenna illustrated in FIGS. 1A and 1B is one type of a slow wave structure. A radiating strip conductor patch with sides 12, 14, 16, 18, 20 is formed on a first side of a thin dielectric substrate or air sheet (not shown), such as a printed circuit board (PCB, not shown) which may be constructed of 1.6 mm, 1 oz. double sided FR-4 glass-reinforced epoxy laminate. The radiating strip conductor patch can be visualized as made up of two rectangles and an isosceles right triangle that are separated by dashed lines in FIG. 1A. The first rectangle has a shorter side 20 and a longer side 16. The isosceles right triangle has a hypotenuse 18 extending from one end of the shorter side 20 of the first rectangle to side 14 of the second rectangle. One leg of the isosceles right triangle is adjacent a side of the second rectangle perpendicular to side 14. Opposite side 16 of the first rectangle is a side (illustrated using a dashed line) that is co-linear and contiguous with the other leg of the isosceles right triangle and co-linear and contiguous with the side of the second rectangle opposite side 14. The antenna is connected to a radio transceiver (not shown) mounted on the PCB via transmission line formed of segments 22, 24, 26, 28. A metallic ground plane 40 is formed on the second side of the PCB, opposite the first side. Such a patch antenna can be made conformal to a metallic surface and produced at low cost by using photo-etch techniques. The permittivity $\varepsilon r$ should be low to enhance fringe fields which account for the radiation, unless other performance and design requirements dictate the use of substrates whose realistic permittivities $\varepsilon r$ may be greater than 5. The transmission line 22, 24, 26, 28 on the dielectric substrate also exhibits slow-wave characteristics, such that the effective electrical length of the slow-wave structure is greater than its actual physical length.

Another method to expand an antenna's bandwidth is to use fractal elements. Fractals are known in the art as solutions to significantly reduce the antenna size, without degenerating the performance. Moreover, applying fractal concept to antennas can be used to achieve multiple frequency bands and increase bandwidth of each single band due to the self-similarity of the geometry. Shaping in a fractal fashion, either through bending or shaping a surface, or introducing slots and/or holes can achieve the self-similarity of the antenna's geometry. Typical fractal antennas are based on fractal shapes such as the Sierpinski gasket, Sierpinski carpet, Minkovski patches, Mandelbrot tree, Koch curve, Koch island, etc.

The transmission line 22, 24, 26, 28 of patch antenna 10 illustrated in FIG. 1A is a single order fractal signal feed constructed over the ground plane 40 illustrated in FIG. 1B with sides 42, 44, 46, 48, 50, 52 and 54. If printed on a clear PCB and viewed from the top, segments 24, 26 and 28 would be visible over ground plane 40 and segment 22 of the transmission line and side 44 of the ground plane 40 would be adjacent or overlap, partially or completely.

Figure 2:
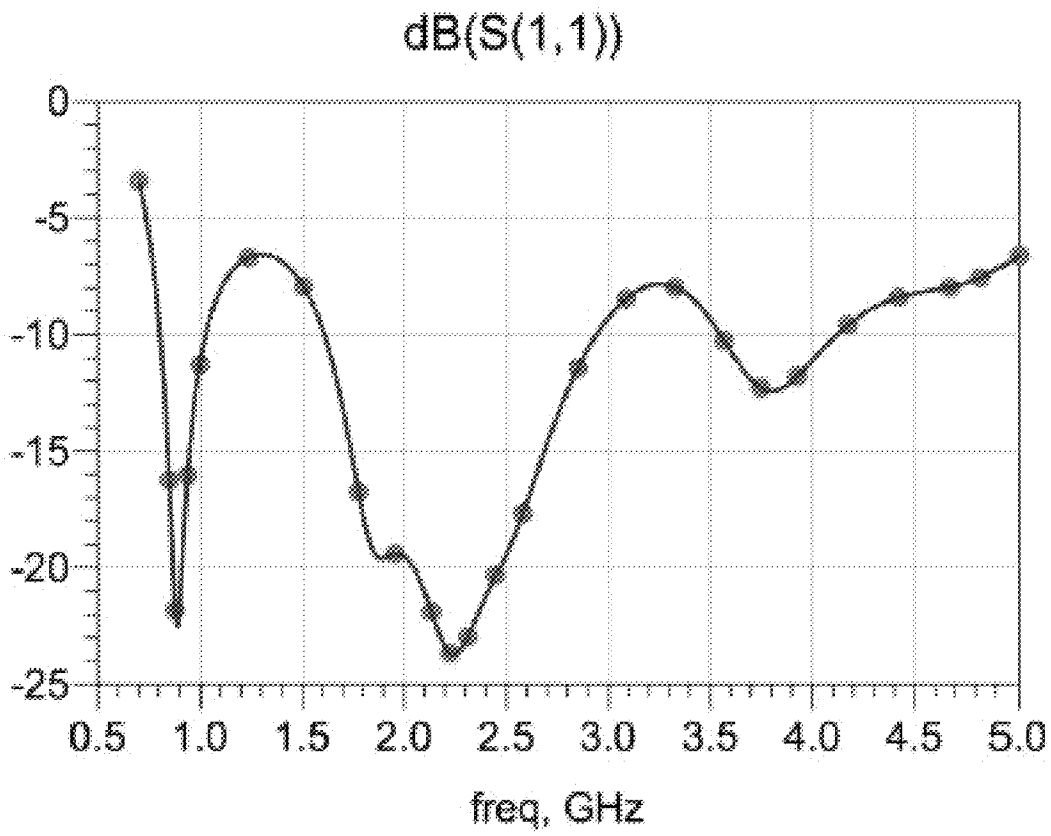
FIG. 2 is a graph of gain for the antenna illustrated in FIGS. 1A and 1B.

An embodiment of the antenna with the following dimensions has the gain illustrated in FIG. 2:

| Side/Segment | Length |
|---|---|
| 12 | 33 mm |
| 14 | 25 mm |
| 16 | 46 mm |
| 18 | 29.7 mm |
| 20 | 9 mm |
| 22 | 16.2 mm |
| 24 | 17 mm |
| 26 | 17 mm |
| 28 | 28.25 mm |
| 42 | 18 mm |
| 44 | 17 mm |
| 46 | 12 mm |
| 48 | 29.7 mm |
| 50 | 30 mm |
| 52 | 51 mm |
| 54 | 69 mm |

These dimensions allow the antenna to be easily excited and operated at or near a resonant frequency, limiting the energy dissipated in resistive losses and maximizing the transmitted energy, including an antenna impedance within 2% of optimal 50 ohms in the operating frequencies of 800 MHz and 5 GHz. However, as know in the art, the size and shape of the patch antenna and ground plane can be modified and still obtain satisfactory performance. For example, a 20% increase in the overall size of the patch antenna and ground plane shifts the frequency range illustrated in FIG. 2 towards lower frequencies, such as 640 MHz to 4 GHz, while a 20% decrease in the overall size shifts the frequency range towards higher frequencies, such as 960 MHz to 6 GHz.

The graph illustrated in FIG. 2, depicts the S(1,1) losses of the embodiment of the antenna described above in dB versus frequency. A 0 dB point on the graph means that at that frequency, no electromagnetic radiation propagates; that is, that the antenna does not work at that frequency. At −25 dB most RF energy is being propagated, indicative of a very good antenna at that frequency. The entire graph illustrated in FIG. 2 indicates that this antenna works continuously in all the claimed ranges, in some frequencies more efficiently than others, but without the major dips seen in other antenna designs.

The many features and advantages of the embodiments are apparent from the detailed specification and, thus, it is intended by the appended claims to cover all such features and advantages of the embodiments that fall within the true spirit and scope thereof. Further, since numerous modifications and changes will readily occur to those skilled in the art, it is not desired to limit the inventive embodiments to the exact construction and operation illustrated and described, and accordingly all suitable modifications and equivalents may be resorted to, falling within the scope of the claims which may include the phrase "at least one of A, B and C" as an alternative expression that means one or more of A, B and C may be used, contrary to the holding in Superguide v. DIRECTV, 358 F3d 870, 69 USPQ2d 1865 (Fed. Cir. 2004).

What is claimed is:

1. An antenna comprising:

a dielectric substrate having first and second sides opposing each other;

a first conductive pattern formed on the first side of the dielectric substrate forming an asymmetrical monopole with a single order fractal signal feed, the first conductive pattern being a five-sided polygon formed by combining first and second rectangles and an isosceles right triangle, the first rectangle having first and second shorter sides with lengths within 65% of the lengths of first and second longer sides, the first longer side of the first rectangle adjacent a first leg of the isosceles right triangle, the isosceles right triangle having a hypotenuse extending from a first corner formed by the first shorter side and the first longer side of the first rectangle to a second corner of the second rectangle, a second leg of the isosceles right triangle adjacent a first longer side of the second rectangle, with one of two shorter sides of the second rectangle adjacent the first longer side of the first rectangle and co-linear and contiguous with the first leg of the isosceles right triangle, and a second longer side of the second rectangle being co-linear and contiguous with the second shorter side of the first rectangle; and a second conductive pattern formed on the second side of the dielectric substrate, forming a ground plane under the single order fractal signal feed.

2. The antenna as recited in claim 1, wherein the lengths of the longer sides of the first rectangle are within 20% of 33 mm and the lengths of the shorter sides of the first rectangle are within 20% of 25 mm.

3. The antenna as recited in claim 1, wherein the single order fractal signal feed has first and second co-linear segments joined by first and second angled segments, the first and second angled segments joined at first ends forming a third corner having a substantially 90° angle, the first co-linear segment having a side co-linear and contiguous with the second longer side of the second rectangle.

4. The antenna as recited in claim 3, wherein the first angled segment of the single order fractal signal feed having a second end joining the first co-linear segment of the single order fractal signal feed and having a side co-linear with the hypotenuse of the isosceles right triangle.

5. The antenna as recited in claim 4, wherein the first co-linear segment and the first and second angled segments of the single order fractal signal feed have lengths within 20% of 16 mm, the lengths of the longer sides of the first rectangle are within 20% of 33 mm and the lengths of the shorter sides of the first rectangle are within 20% of 25 mm.

6. The antenna as recited in claim 1, wherein the dielectric substrate is part of a printed circuit board on which a radio transceiver is mounted, the printed circuit board having wiring formed thereon connecting the single order fractal signal feed and the radio transceiver.

7. The antenna as recited in claim 1, wherein the dielectric substrate is constructed of FR-4 glass-reinforced epoxy laminate.

* * * * *